US005333428A

United States Patent [19]

Taylor et al.

[11] Patent Number: 5,333,428

[45] Date of Patent: Aug. 2, 1994

[54] METHOD AND APPARATUS FOR CREATING DESIGN INSULATED GLASS

[75] Inventors: George S. Taylor; Barry Benedict, both of Salt Lake City, Utah

[73] Assignee: Big Unlimited, Salt Lake City, Utah

[21] Appl. No.: 967,584

[22] Filed: Oct. 28, 1992

Related U.S. Application Data

[63] Continuation-in-part of Ser. No. 703,218, May 20, 1991, abandoned.

[51] Int. Cl.[5] ..... E04C 1/42

[52] U.S. Cl. ..... 52/308; 52/235; 52/311.2; 52/311.3; 264/254

[58] Field of Search ..... 156/63, 99; 264/245, 264/248; 52/403, 456, 308, 235, 311.2, 311.3

[56] References Cited

U.S. PATENT DOCUMENTS

| | | | |
|---|---|---|---|
| 237,418 | 2/1881 | Tiffany | 428/38 |
| 283,093 | 8/1883 | Fredrick | 52/482 |
| 1,411,347 | 1/1923 | Henderson | 52/456 |
| 1,432,396 | 10/1922 | Hurley | 52/823 |
| 1,686,809 | 10/1928 | Grau | 428/38 |
| 2,157,425 | 5/1939 | Nelson | 52/402 |
| 2,641,031 | 6/1963 | Ehret | 52/403 |
| 2,991,213 | 7/1961 | Williams | 52/308 |
| 3,226,903 | 1/1966 | Lillethun | 52/311 |
| 3,420,730 | 1/1969 | Ellefson | 156/63 |
| 3,460,303 | 8/1969 | Algrain et al. | 52/308 |
| 3,512,320 | 5/1970 | Ferron et al. | 52/311 |
| 3,791,095 | 2/1974 | Martin | 52/578 |
| 4,044,519 | 8/1977 | Morin et al. | 52/304 |
| 4,335,552 | 6/1982 | Blanchett et al. | 52/400 |
| 4,343,758 | 8/1982 | Goralnik | 428/38 |
| 4,610,115 | 9/1986 | Thompson | 52/788 |
| 4,756,938 | 7/1988 | Hickman | 156/63 |
| 4,783,938 | 11/1988 | Palmer | 51/171 |
| 5,039,468 | 8/1991 | Sellers | 264/225 |
| 5,131,199 | 7/1992 | Clark | 52/456 |

FOREIGN PATENT DOCUMENTS

| | | | |
|---|---|---|---|
| 329700 | 8/1903 | France | 52/456 |
| 2330827 | 6/1977 | France . | |
| 16574 | of 1897 | United Kingdom | 359/592 |

*Primary Examiner*—James L. Ridgill, Jr.
*Attorney, Agent, or Firm*—Lynn G. Foster

[57] ABSTRACT

Method and apparatus for providing an I.G. unit comprising at least two lites and a spandrel comprising a single lite for use in building construction, and especially for use as part of a building facing. At least one of the lites of the I.G. unit comprises a plurality of glass sections joined by at least one interposed joining member. Each I.G. unit is hermetically sealed and comprises a strength against wind load, atmospheric pressure changes, and other window stressing environmental factors which may be greater than a like sized, conventionally constructed I.G. unit. Each spandrel comprises a lite of similar appearance, construction, and strength against wind load to that of a lite for the I.G. unit whereby mechanical workings of the building between windows are concealed with lites of the spandrels providing substantially the same appearance and patterns as those provided by I.G. units on the visual areas of the building. The invention enables I.G. units to be installed in lattice frameworks of buildings to form complex designs which are illustrated on building exteriors where the I.G. units and spandrels are used. A method is disclosed for easy clean-up of a lite after the glass sections have been joined to the joining member in the lite. A construction which permits supportive attachment of the interposed joining members to the lattice frameworks of the buildings is disclosed.

19 Claims, 8 Drawing Sheets

METHOD AND APPARATUS FOR CREATING DESIGN INSULATED GLASS

CONTINUITY

This application is a continuation-in-part of copending U.S. patent application Ser. No. 07/703,218, filed May 20, 1991, now abandoned.

FIELD OF INVENTION

This invention relates to the field of insulated glass windows and spandrels and more particularly to insulated design glass windows and spandrels comprising lites with a plurality of glass sections.

DESCRIPTION OF RELATED ART

Insulated glass windows and spandrels are commonly used in construction of house and building exteriors. The current insulated glass windows (I.G. units) art generally comprises two panes of glass separated by a sealed air space and held apart by an interposed spacer peripherally surrounded by a sealant. The spacer is usually filled with a desiccant to minimize the effect of condensing water on the inner surface of the windows.

Due to the structural characteristics of such I.G. units and spandrels and the orthogonal or regular nature of construction, I.G. units and spandrels are generally regular geometric shapes such as rectangles and triangles. Each pane of each I.G. unit and spandrel also generally comprises a single piece of glass. The result of the use of regular geometric shapes of single glass panes in building construction is a uniform and somewhat sterile appearance which often comprises only the shapes and lines which correspond to those of unit construction parts.

In the current art, a design pattern is sometimes added to an I.G. unit by interposing one or more sheets of colored glass between exterior and interior panes. However, in such design patterns, the overlayer of glass exterior and interior panes distractively diminishes the pattern contribution of the one or more inner sheets due to reflection, refraction, and discoloration due to impurities in the exterior or interior light transmitting pane. The physical offset from an external surface of the one or more inner sheets further diminishes the appearance contribution of the inner sheets as well as further complicating pattern matching by neighboring spandrels.

Currently, those who are skilled in the art consider it to be impractical to use two different pieces of glass in an exteriorly exposed lite, such as one might visualize in a simple stained glass window. For this reason, there are no known buildings having facings comprising large decorative I.G. units which comprise exposed lites having multiple pieces of glass.

Environmental stresses comprising extreme temperature changes, wind load and other pressure variants due to atmospheric and other environmental factors cause cracking and separation between cames and glass in contemporary exposed multiple glass piece windows. Such cracking and separation results in atmospheric air leakage resulting in condensation or "clouding" inside the insulated glass unit (I.G. unit) and sometimes ultimate structural failure of the window due to the inability of such I.G. units and spandrels to withstand such environmental stresses. An example of a recent attempt to solve such problems is the fabrication of stained glass lites hermetically sealed between two panes of glass in currently available I.G. units.

Further, in modern construction of high rise buildings, vertical and horizontal mullions and associated glass retaining pressure plates used to retain exterior windows in the buildings are normally designed to interface with planar surfaces, such as panes of glass. As such, little or no window support is afforded by the mullions other than to edges of planar surfaces.

BRIEF SUMMARY AND OBJECTS OF THE INVENTION

Herein, a window surface, comprising at least one piece of glass and a part of the invention, is called a lite to distinguish from a single whole sheet of glass. The term window pane is used where each window surface is restricted to a single piece of glass as in a conventional insulated window. Each piece of glass which, in combination with other pieces forms the lite, is called a section. Sections are united in a lite by a joining member. The action of assembling an insulated window is called glazing. To glaze an insulated window, a plurality of spacers are disposed around the edge of the window between two lites, and peripherally surrounded by a sealant to provide a hermetically sealed I.G. unit.

In brief summary, this novel invention alleviates all of the known problems related to providing an I.G. unit for use on exterior and interior building surfaces wherein at least one surface comprises more than one section of glass. As such, different sections of glass may be used in a single lite, providing the opportunity for unlimited patterns of shapes and colors at the surface of both exterior and interior windows. In like fashion, spandrels comprising matching patterns of external surface shapes and colors are provided.

The invention comprises a lite fabricated from multiple sections of glass which is surprisingly strong and stress resistant. An I.G. unit or spandrel comprising such a lite is able, therefore, to withstand great wind load and other environmental stresses I.G. units and spandrels are usually manufactured in standard, current construction sizes. However, it should be apparent to one skilled in the art that the invention further provides the potential for making and installing larger I.G. units and spandrels comprising multiple glass section lites than for conventional insulated windows comprising single panes of glass. The multiple section lites further have the additional advantages of a plurality of individual pieces of glass which can be selected from a multiplicity of colors and textures of glass providing opportunity for a large variety of aesthetically appealing window patterns. This invention enables most designs to be illustrated on building exteriors where only simplistic patterns of glass windows have been used in the past.

As such, I.G. units and spandrels are affixed to members of an exterior lattice framework of a building to provide a varying and non-uniform outside appearance. Individual I.G. units and spandrels are attached to the lattice framework to provide an integrated exterior building appearance which is patterned by the colors of glass sections in the I.G. units and spandrels. In combination, the attachment to the lattice framework and the structural strength of the I.G. units and spandrels comprise a surface which effectively resists and withstands wind load and other environmental stresses.

The invention comprises glass precut into patterned sections, each of which forms a portion of a lite of an I.G. unit or spandrel. Joining members, each member preferably comprising a length of an H-shaped part, are formed to coincide with each section-to-section interface and interposed therebetween to form the connecting portion of the lite. At least a portion of each medial edge of each glass section is adhesively affixed by a resilient sealant to an H-shaped part to seal the joint and form a complete, hermetically sealed lite.

Spacers are disposed around the perimeter of two juxtaposed lites and interposed there between to form a double glazed I.G. unit. End portions of each H-shaped part which interfere with attachment to a spacer are removed. Also, each end portion of each H-shaped part which interferes with attachment to the lattice framework is removed. However, a portion of each such H-shaped part end is retained to provide a cantilevered pressure retained connection between the H-shaped part and the attaching lattice framework.

Each lite is thereafter adhesively bonded to each interposed spacer to form the I.G. unit. A sealant, interposed between the glass lites and surrounding the perimeter of the spacers, forms a hermetic seal. Each spacer comprises moisture absorbing desiccant to reduce the effect of condensing water vapor inside the window.

To provide for easier cleaning and edging of adhesive sealant which distractively flows to visible portions of the window from the H-shaped member, when a section of glass is inserted therein, a thin band of tape is disposed at the line where the H-shaped part and glass section medially juxtapose. The tape covers the area where the sealant extrudes when the H-shaped part and section are joined. A razor or other sharp tool is used to remove the excess sealant by cutting the cured sealant and tape flush with the edge of the H-shaped extrusion and peeling the cut portion of the tape away for easy clean-up.

Where H-shaped members comprise borders which, for continuity of aesthetic lines, require a continuation along the edge of a window, "C" "L" and "T" shaped edge members are used. By using available colors and reflectivity of high technology glass for building exteriors or interiors an infinite number of patterns is available.

Accordingly, it is a primary object to provide apparatus and related methods for affixing a plurality of I.G. units and/or spandrels comprising exteriorly exposed lites formed from a plurality of sections of glass to a lattice framework of a building such that the I.G. units and spandrels alike withstand and remain hermetically sealed against the rigors of wind and other environmental stresses.

It is another primary object to provide a method for joining a glass section for use in a lite of an I.G. unit or spandrel to at least one other adjoining glass section by a joint comprising an adhesively bonded hermetic seal.

It is a another primary object to provide an I.G. unit comprising at least one exteriorly exposed lite which comprises a plurality of sections of glass.

It is another primary object that at least one lite comprising a plurality of sections of glass in an I.G. unit be at least two lites.

It is another primary object to provide a method for glazing an I.G. unit which yields a hermetically sealed I.G. unit.

It is a another primary object to provide an exteriorly exposed spandrel for use as a part of a building facing which comprises at least one lite comprising a plurality of sections of glass.

It is another primary object to provide a lite comprising a plurality of sections of glass as a building facing component on the exterior surface of the I.G. unit or spandrel.

It is another primary object to provide a lite comprising a plurality of sections of glass as an exterior window or spandrel which comprises a strength to withstand wind load, atmospheric pressure change and other environmental forces which.

It is an important object to provide a method of double or multiple glazing an I.G. unit comprising at least one lite which comprises a plurality of sections of glass.

It is an important object to provide a method of glazing a spandrel comprising at least one lite which comprises a plurality of sections of glass.

It is another object to provide a method of adhesively joining each glass section to a joining H-shaped part interposed between adjoining sections.

It is another object to provide a method of joining each section to a channel of each joining H-shaped part by an adhesive and resilient sealant which is placed in each channel in the H-shaped part and which bonds with the glass and channel of the H-shaped part when the glass is inserted into the channel.

It is another object to provide a method for easily cleaning excess sealant extruded from the channel after the glass is joined with the H-shaped part.

It is another object to provide a joining H-shaped part which provides a visible and aesthetically appealing border between adjoining sections of the lite.

It is another object to provide "C", "L" and "T" shaped members which are used to continue H-shaped part border lines along edges of the lite.

These and other objects and features of the present invention will be apparent from the detailed description taken with reference to accompanying drawings.

BRIEF DESCRIPTION OF THE DRAWINGS

FIG. 11 is a side elevation of a segment of a building with parts removed to show a single I.G. unit disposed between vertical and horizontal mullions;

DETAILED DESCRIPTION OF THE ILLUSTRATED EMBODIMENTS

Figure 1:
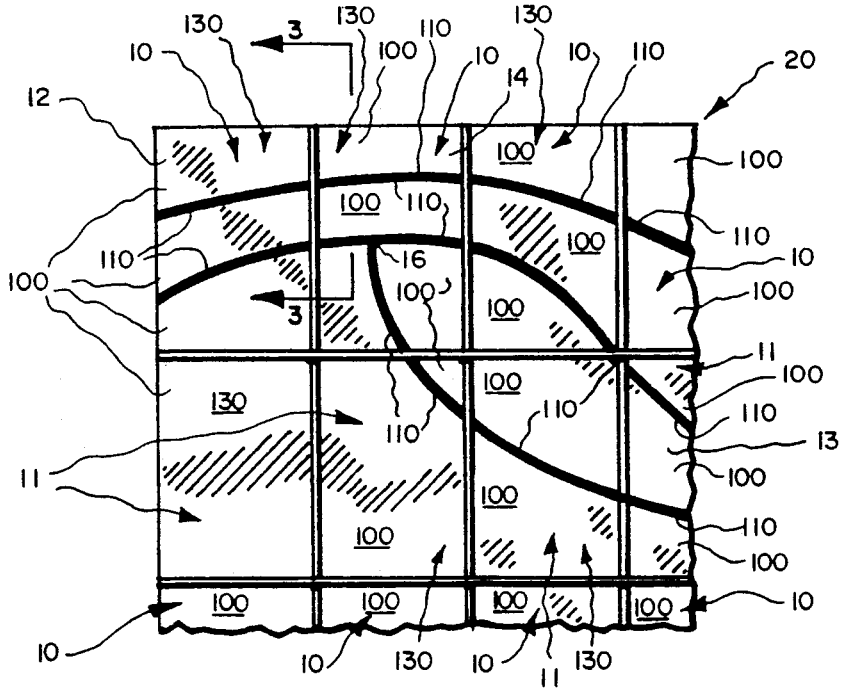
FIG. 1 is a side elevation of an exterior portion of a building comprising a plurality of I.G. units, each window comprising a lite which comprises one or more sections of glass.

Reference is now made to the embodiments illustrated in FIGS. 1-14B wherein like numerals are used to designate like parts throughout. The figures illustrates I.G. units, generally designated 10, and spandrels, generally designated 11, seen disposed on the exterior of a portion of a building 20, in FIG. 1. A view of a large decorative pattern provided by an array of I.G. units 10 disposed across a substantial portion of a building 20' is seen FIG. 1*a*. A plurality of the I.G. units 10 in building 20' comprise multiple sections of glass which are displayed on the exterior surface of building 20' and directly encounter the force of wind load and other environmental stresses imposed upon the exterior of building 20'.

Referring again to FIG. 1, each I.G. unit 10 is disposed to cover a visual area, such as areas used for windows. Each spandrel 11 is disposed to cover areas through which no light should pass, such as mechanical workings of building 20 disposed between the visual areas comprising I.G. units 10 of building 20. Glass for each spandrel 11 is selected to conform in color and pattern to that of an associated I.G. unit 10, but is applied on the inward surface with an opacifying substance and often is backed with a sheet of foam as described in detail hereafter.

Each I.G. unit 10 and each spandrel 11 comprises at least one glass section, generally designated 100. When an I.G. unit 10 or a spandrel 11 comprises more than one glass section 100, as seen in corner window 12 and medially-laterally disposed spandrel 13, each section 100 is separated by a one-piece H-shaped connector or joining member, generally designated 110. As seen in window 14, adjacent corner window 12, each H-shaped part 110 comprises two ends which are both disposed at an edge of the associated I.G. unit 10 or spandrel 11 or, alternatively, at least one end of which is disposed abutting another H-shaped part 110 as seen at site 16 in window 14.

Figure 5:
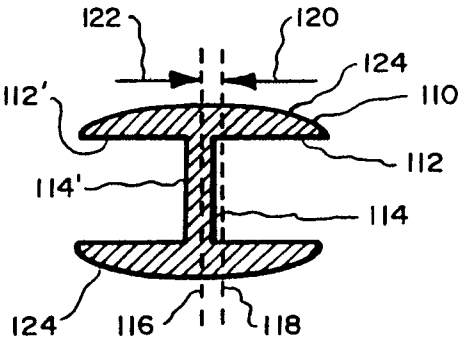
FIG. 5 is a cross section of the H-shaped part.

An example of H-shaped part 110 is seen in cross section in FIG. 5. Each H-shaped part 110 may be made by extrusion as is well known and practiced in the art. Such extrusions are widely known and commercially available. Materials used for the H-shaped part 110 may be metal or synthetic resinous material; however, the currently preferred embodiment comprises H-shaped aluminum extrusion.

Figure 8:
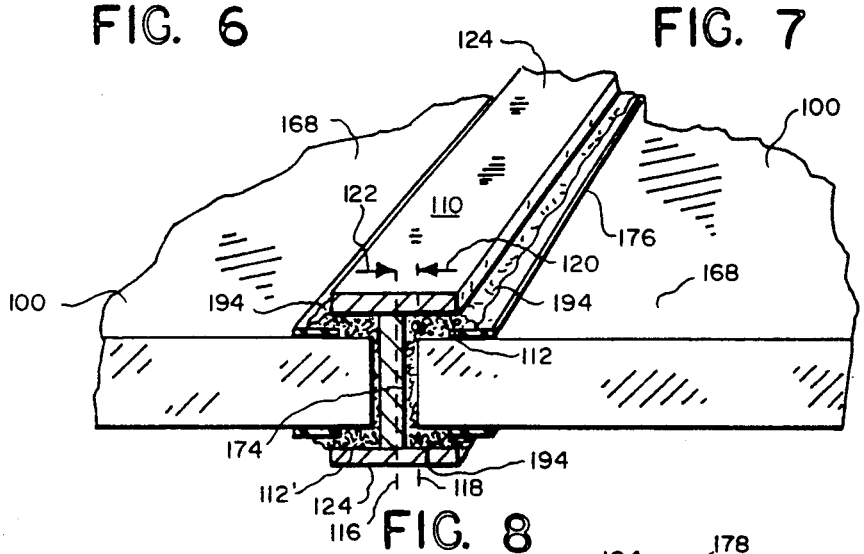
FIG. 8 is a perspective of a section of a lite wherein two sections of glass are seen disposed in opposing channels of an H-shaped part wherefrom sealant is extruded onto strips of tape disposed on the glass as each section of glass is forced into the associated sealant containing channel.

As seen in FIG. 5, each H-shaped part 110 comprises two U-shaped channels 112 and 112' separated by a tactangular segment or web and flanked by flanges Each U-shaped channel 112 and 112' comprises a base 114 and 114', respectively, juxtaposed back-to-back. Thus, each H-shaped part 110 comprises a cross section which is symmetrical about a center line 116. As is disclosed in detail hereafter, an edge of a glass section 100 is inserted into a channel 112, 112' after a sealant is disposed therein, to be bonded to H-shaped part 110. Line 118 is a measure of the depth of penetration of the edge of a glass section 100 when inserted into channel 112, the edge clearance of space between the inserted edge of glass section 100 and the base 114 is filled with a bonding sealant, as described in detail hereafter. The distance between the center line 116 and line 118 as signified by arrows 120 and 122 is the measure of the reduction in size of each glass section 100 necessary to interpose a joining H-shaped part 110 and sealant between two adjacent glass segments 100 to make a lite having a predetermined size. Each outer flange surface 124 of H-shaped part 110 may be curved as seen in FIG. 5 or non-curved as seen in FIG. 8. The curvature of surface 124 being selected to meet aesthetic design criteria established by a designer, architect, or glass artist.

Figure 2:
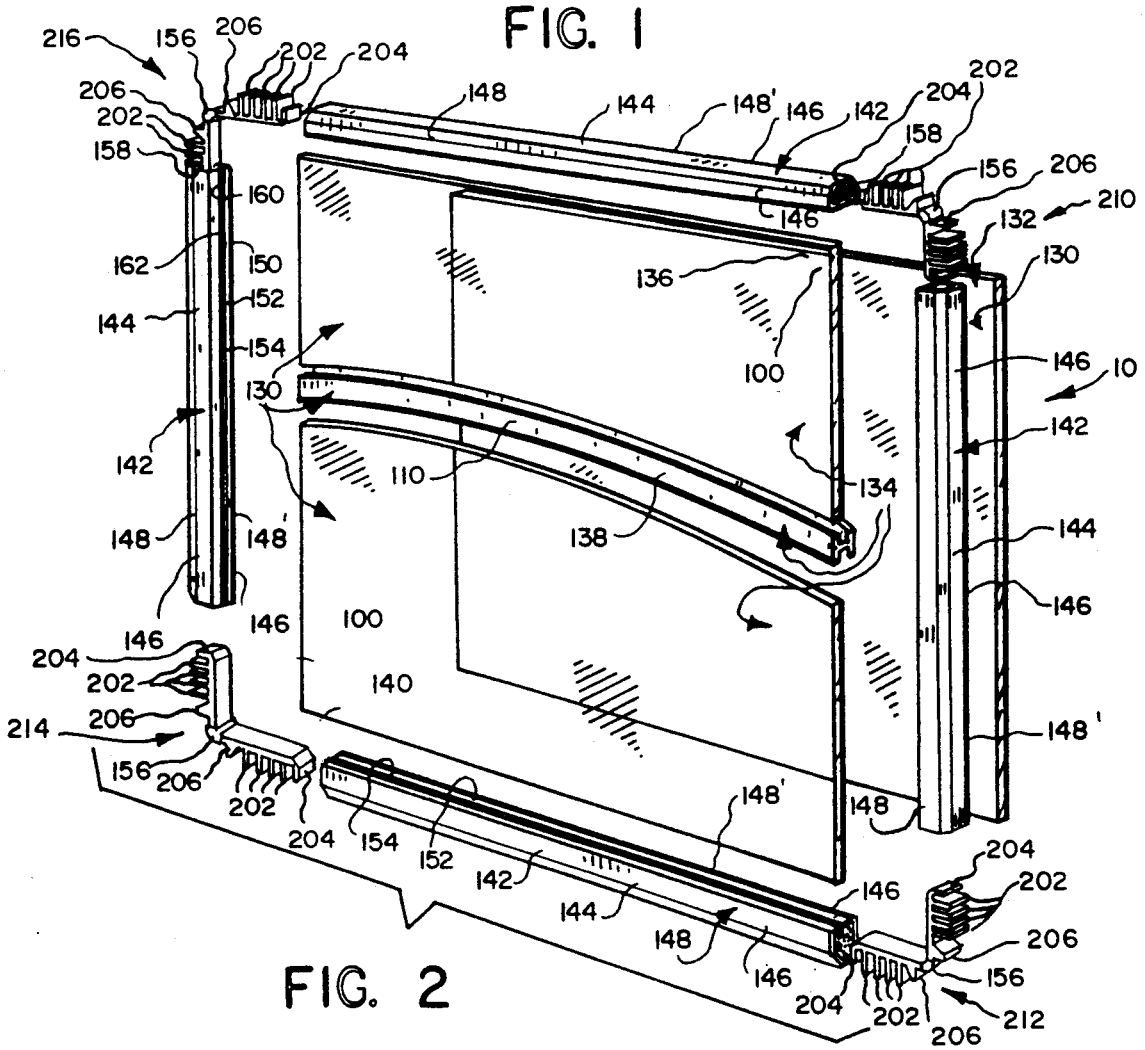
FIG. 2 is an exploded view of an I.G. unit comprising a single sheet of glass on one side and another lite comprising two sections of glass on the other side.

As seen in FIG. 2, I.G. unit 10 comprises two juxtaposed lites, generally designated 130. Although each lite 130 can comprise a plurality of sections, lite 132 which appears distal from the viewer in FIG. 2 comprises only a single sheet of glass in this example. Lite 134, on the other hand, comprises an upper section 136, a joining H-shaped part 138, and a bottom section 140. As mentioned earlier, sections 136 and 140 are reduced in size next to adjacent H-shaped part 110 to allow for the interposed edge clearance signified by arrows 120 and 122 seen in FIG. 5 in order for lite 132 to be the same size and shape as lite 134. The process and materials for joining sections 136 and 140 are not provided in FIG. 2, for clarity of presentation of I.G. unit 100 peripheral connections. However, a disclosure of the glass section 100 to H-shaped part 110 relative to joining such parts seen in FIG. 2 is provided in FIGS. 8, 8A and 8B.

A plurality of spacers, generally designated 142, are disposed between lites 132 and 134, thereby providing an insulating volume of air therebetween. Except for length, each spacer 142 is substantially the same as each other spacer 142. For this reason only leftmost spacer 150 in FIG. 2 is described in further detail.

Figure 3:
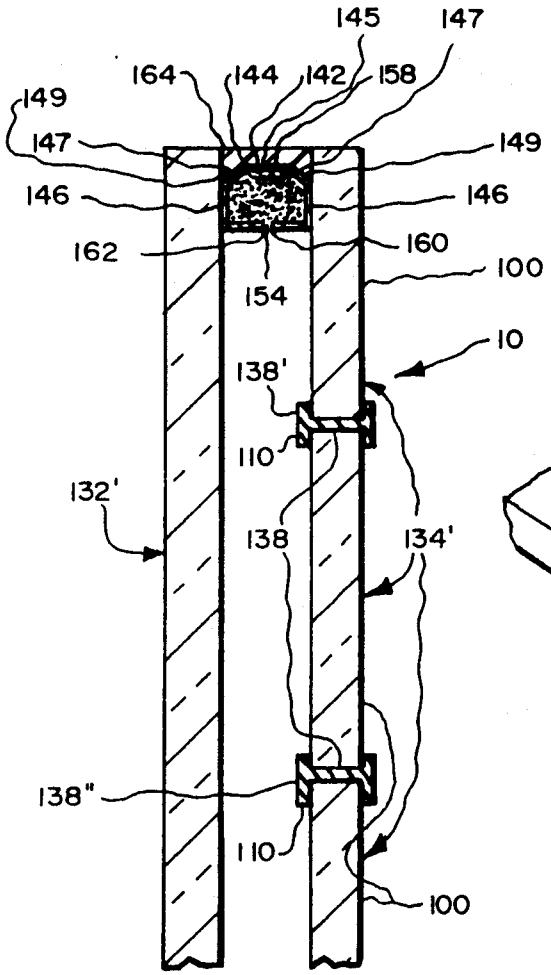
FIG. 3 is a section along lines 3—3 of FIG. 1.

Spacer 150 comprises a tube 144 formed by bending or extruding. Tube 144 comprises a cross section having a smooth closed surface 146 on each of two sides 148, 148'. While the cross section of tube 144 may comprise various shapes, the currently preferred cross section is best seen in FIG. 3. Therein the external surface 145 of tube 144 is seen to comprise a pair of fluted edges 147 whereby top surface 145 is arcuately bent to join each closed surface 146 on sides 148 and 148'. Each fluted edge 147 provides a groove 149 for sealant when tube 144 is disposed as a spacer 150 between lites 132 and 134, as described in detail hereafter. Such tubes are known and available in the art and may be a CRL Single Seal Spacer from C.R. Lawrence Co. Inc., 2503 East Vernon Avenue, Los Angeles, California 90058.

Tube 144 is filled with a desiccant 158 to maintain an uncondensing atmosphere inside insulation window 10, after it is glazed and hermetically sealed. A cap may be disposed on each open end of tube 144 to thereby contain desiccant 158; however in the currently preferred embodiment a spacer corner part 156 is inserted into an end of each adjoining tube 144 as seen in FIG. 2 to form corners 210, 212, 214, and 216 of I.G. unit 10. Each spacer corner part 156 comprises an insertable end 204 which is forced into each associated tube 144. Such spacer corner parts are known and available in the art. Corner part 156, among others, may be a CRL Nylon corner for Standard Spacer, available from C.R. Lawrence Co. Inc., 2503 East Vernon Avenue, Los Angeles, California 90058. As see in FIG. 2, such a corner part 156 comprises a pair of legs 206 joined at a right or other angle, each leg 206 comprising an insertable end 204 and a plurality of tube conforming, bendable teeth 202 which provide a tight, sealing fit when disposed inside tube 144.

On a third side 152 of tube 144, a groove 154 which permits fluid transfer between the inside of desiccant 158 containing tube 144 and the rest of the space inside I.G. unit 10 is medially disposed. Groove 154 is formed by spacing juxtaposed edges 160 and 162 apart during bending or extrusion or by machining after forming of tube 144. The separation of edges 160 and 162 is great enough to provide a flow path for a gas or fluid but narrow enough to retain granules of desiccant 158 inside tube 144.

A spacer corner part 156 is affixed to each end of tube 144 to contain and seal the desiccant 158 thereby and interconnect each normally disposed adjacent tube 144. One currently preferred embodiment of tube 144 comprises bent aluminum. Another currently preferred embodiment of spacer 150 is a silicon spacer impregnated with desiccant.

Figure 4:
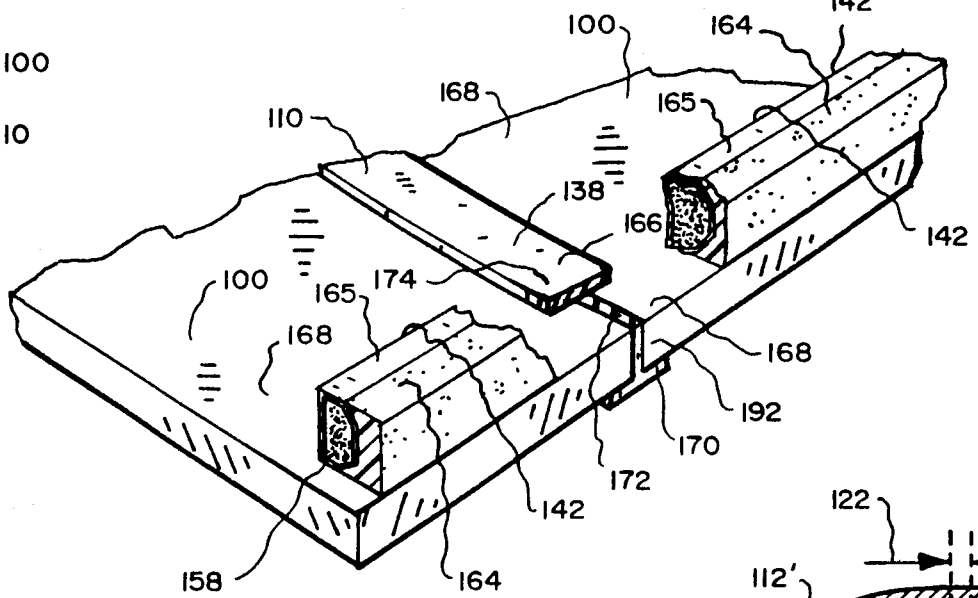
FIG. 4 is a perspective of a portion of an I.G. unit wherein a spacer is disposed upon a lite comprising an H-shaped part interposed between two sections of glass with a segment of the spacer removed for a better view of otherwise hidden parts.
Figure 8A:
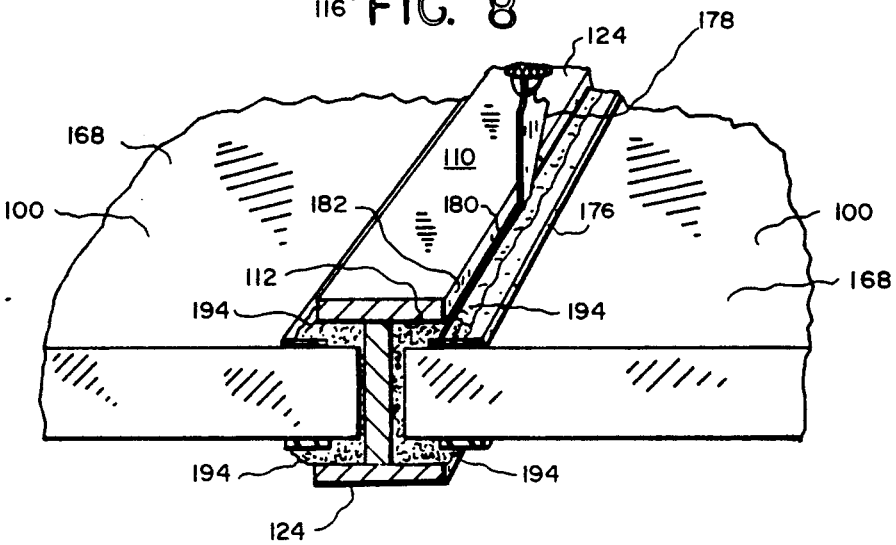
FIG. 8*a* is a perspective similar to FIG. 8 wherein a tool with a sharp cutting edge is seen dividing the tape and extruded sealant along an edge of the H-member.
Figure 8B:
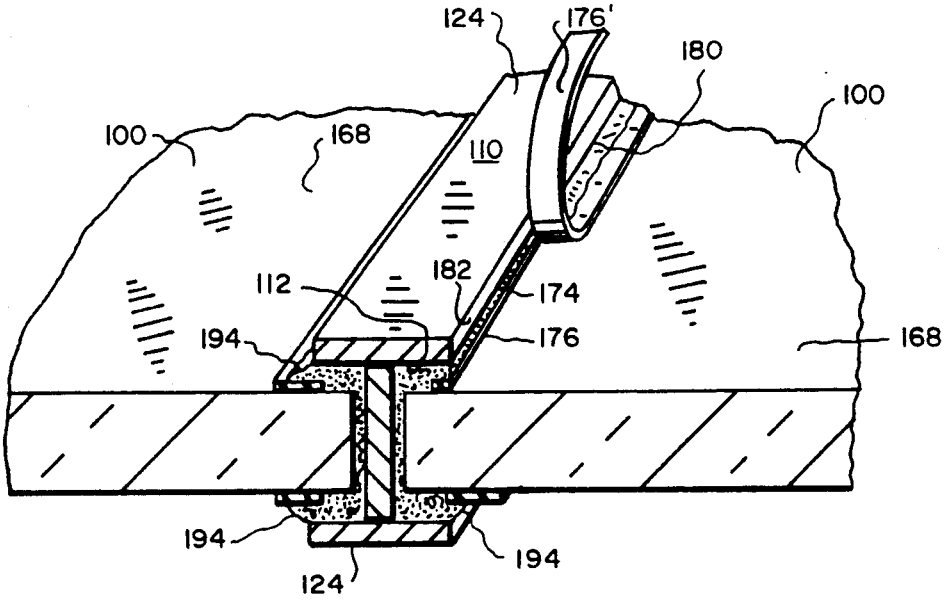
FIG. 8*b* is a perspective similar to FIG. 8*a* wherein the tape and excess extruded sealant are being removed by peeling the tape from the glass.

Lite 130 is assembled by joining each section 100 to an interposed H-shaped part 110 as best seen in FIGS. 3 and 4 and in more detail in FIGS. 8, 8*a*, and 8*b*. In FIG. 3, a cross section of a portion of an assembled I.G. unit 10 is seen. The left-most lite 132' comprises a single sheet of glass, similar to lite 132 seen in FIG. 2. The right-most lite 134' comprises three glass sections 100, and two interposed H-shaped parts, designated 138' and 138''. One spacer 142 is seen interposed between lites 132' and 134'. A sealant 164 is disposed between spacer 142 and each lite 132' and 134' to hermetically seal the edge of I.G. unit 10 where spacer 142 resides.

Reference is made to a partially assembled I.G. unit 10 seen in FIG. 4. Segmented parts seen therein comprise on H-shaped part 138, two glass sections 110, and a spacer tube 142. To provide a high quality seal between the juxtaposed surface 165 of each spacer tube 142 and each inward facing surface 168 of each section 110, a flange portion of H-shaped part 138 is removed from the medial side 166 leaving only a "T" shaped portion 170 juxtaposed the plane of contact between spacer tube 142 and each section 110. The upward facing bottom 172 of "T" shaped portion 170 is substantially flush with surface 168 and is longer from edge 192 medially to site 174 than tube 142 is wide. Around the periphery of each spacer tube 142, a layer of sealant 164 is applied to hermetically seal the edges of I.G. unit 10. Sealants which are used in I.G. units are well known and widely commercially available. Such sealants may, among others, comprise silicone and polybutyl-sulfide sealants.

The sealing attachment of two sections 100 to H-shaped part 110 is seen in FIG. 8. As each attachment is essentially the same, only the attachment to channel 112 of H-part 138 is described herein. Before inserting a glass section 100 into channel 112, a predetermined amount of sealant 194 is disposed to partially fill channel 112 and a band of tape 176 is releasibly affixed to surface 168 and disposed such that a part of the tape 176 lies inside or at the edge of channel 112 when section 100 is disposed therein, but also such that, as sealant 194 is displaced and extrudes from channel 112 as section 100 is inserted therein, extruded sealant 194 flows only onto the surface of tape 176. After sealant 194 has cured and solidified, the ragged edge comprising tape 176 and extruded sealant 194 is easily cleaned from the surface 168 of section 100.

As seen in FIG. 8A, a razor or sharp knife blade 178 is drawn along the edge 182 of H-shaped part 110 to produce a clean edge cut 180. The adhesive material in contact with surface 168 is tape 176 adhesive. The separated portions of tape 176 and associated extruded sealant 194 are removed by peeling the freed tape 176' and associated sealant 194 away from surface 168 as seen in FIG. 8B. Sealant 194 may be the same sealant as sealant 164.

Inside channel 112, sealant 194 bonds to each surface of channel 112 and base 114 of H-shaped part 110 and to surface 168 of section 100 to form a connected, compressible and hingeable sealing attachment. This attachment is permissive to small differential movement of section 100 relative to H-shaped part 110 without breaking surface, of channel 112 and base 114, to surface 168 bonding. However, compression of sealant 194 and the unyielding nature of H-shaped part 110 resists larger relative deflections of section 100 to maintain the sealed attachment under wind load and other environmental stresses.

Figure 6:
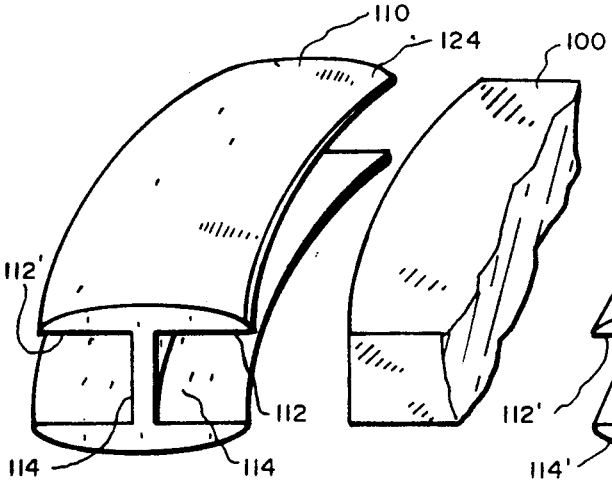
FIG. 6 is a perspective of an H-shaped part curvilinearly formed to match the shape of a curved glass edge.
Figure 7:
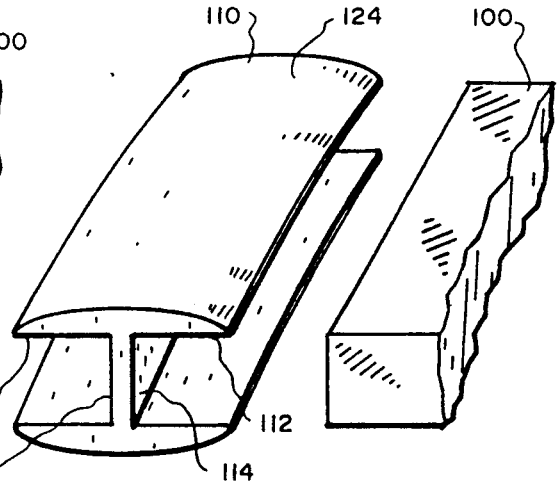
FIG. 7 is a perspective of a straight H-shaped part and matching straight glass edge.

It is critical that each H-shaped part 110 be formed to conformably match the edge of each associated glass section 100. As seen in FIGS. 6 and 7, therefore, each H-shaped part is fashioned to conform to each associated edge of glass section 100 in a curved or straight pattern matching form, respectively. Each glass section 100 is therefore cut to match a pattern and ground smooth (seamed). The seamed glass sections 100 may be heat strengthened or tempered.

Figure 9:
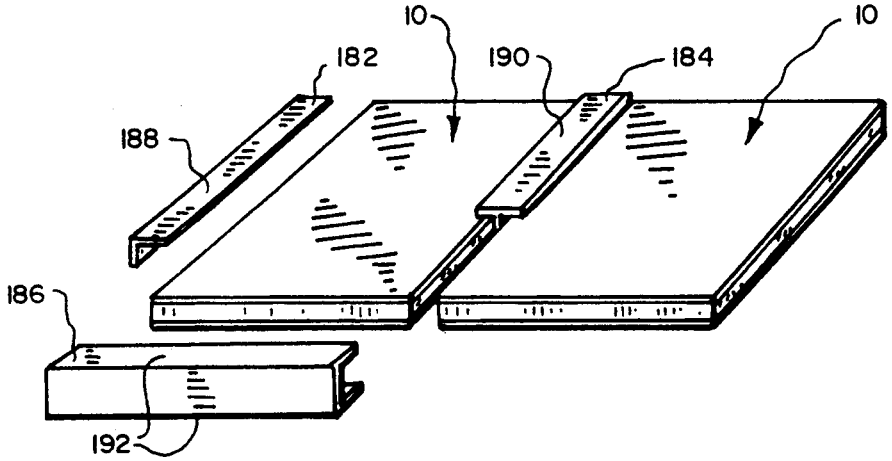
FIG. 9 is a perspective of two lites and edge members comprising "L" a "T" and a "C" shapes.
Figure 10:
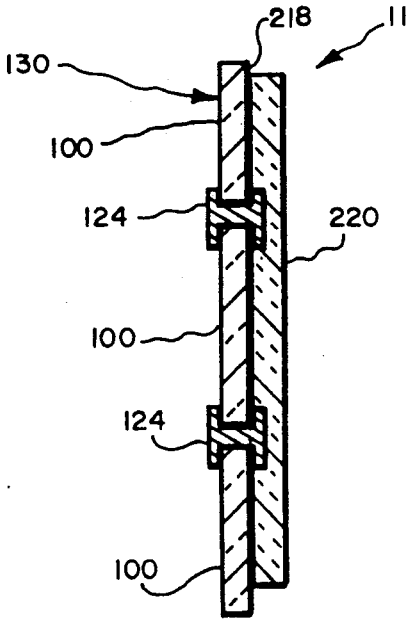
FIG. 10 is a section along lines 10—10 of FIG. 1.

A plurality of edge members used as joining member line extenders are seen in FIG. 9. For those patterns which define a joining H-shaped part 110 which comprises a line along the edge of a lite 130 which should be continued for aesthetic reasons, an "L" member 182, a "T" member 184, or a "C" member 186 is used. Each such "L", "T", and "C" member is applied by bonding as and where needed. Each top surface 188, 190, and 192 of "L" member 182, "T" member 184, and "C" member 186, respectively, is selected to mimic surface 124 of associated H-shaped part 110 to maintain aesthetic continuity.

Figure 1A:
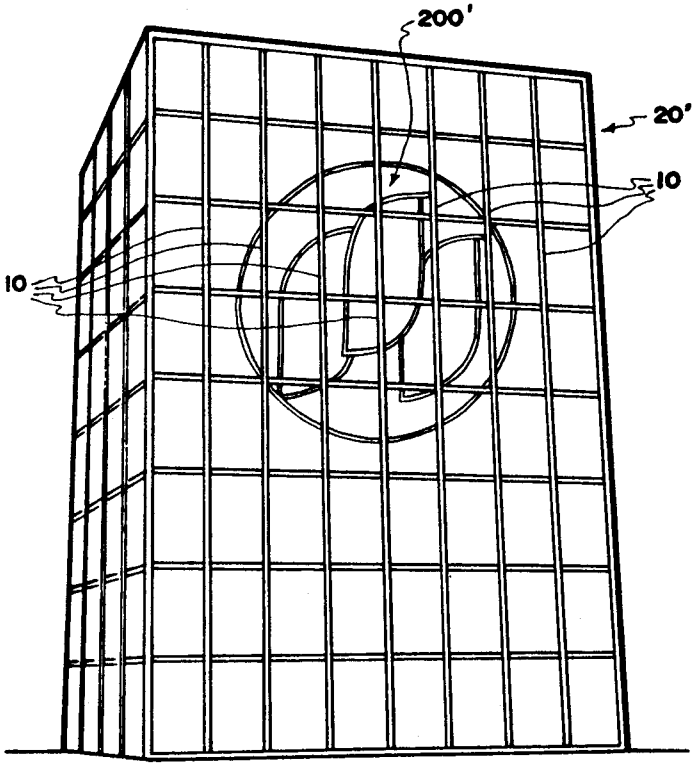
FIG. 1A is a perspective of a building comprising a plurality of I.G. units affixed to a lattice framework on the exterior face of the building.
Figure 1L:
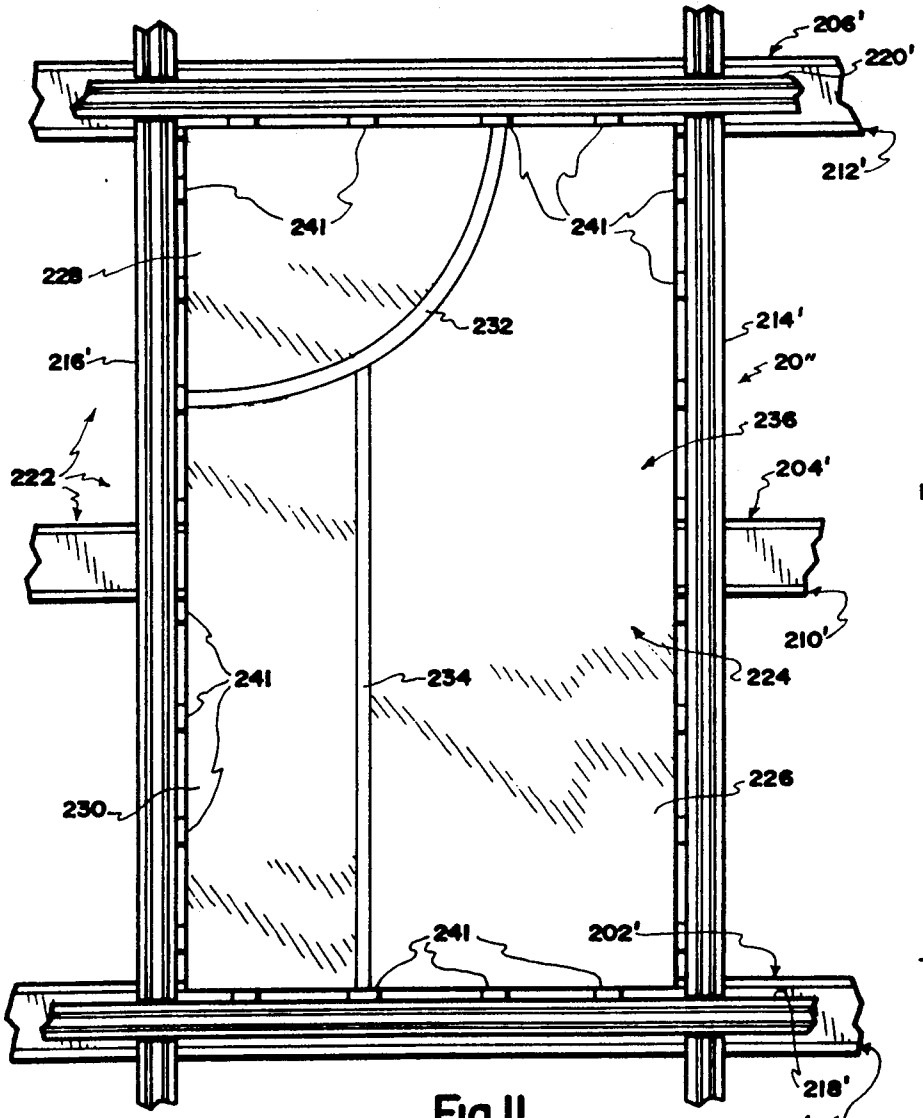

In order to cover a building 20 in a homogeneous manner such that patterns formed across the windows and the opaque mechanical, constructive workings of building 20 between the windows appear substantially the same, spandrel 11 appearance must be like that of I.G. unit 10. In FIG. 1, each lite 130 across the top row is a part of an I.G. unit 10. In the next lower row, each lite 130 is part of a spandrel 11. Each spandrel 11 is generally opaque and thereby conceals the mechanical workings between the windows.

As seen in FIG. 1, each spandrel 11 comprises a lite 130 which is disposed on the exterior surface of building 20. Each lite 130 of each spandrel comprises at least one section 100 and, where more than one section 100 is used, at least one H-shaped part 110 assembled in the same manner as a lite 130 of I.G. unit 10. For this reason, assembly of a lite 130 for spandrel 11 is not further described herein. Referencing the construction seen in FIG. 10, lite 130 is applied with an opacifying substance and may be bonded on the building 20 joining side to an insulating sheet of foam 220 to thereby complete the assembly of spandrel 11.

Referring once more to FIG. 1*a*, the exterior of building 20' comprises an exterior surface covering array of I.G. units 10. A design pattern 200' is seen to be formed by a plurality of I.G. units 10 disposed across the proximal face of building 20'. As such, a plurality of I.G. units 10 comprise multiple sections 100 of glass selected from a variety of colors to add to the pleasing character of design pattern 200'. Each I.G. unit 10 in building 20' is disposed to cover an area between two floors, however for more versatile display, an I.G. unit is often used across multiple floors. It is within the scope of the invention to use an I.G. unit 10 to cover only a partial area between two floors and to cover extended areas across multiple floors.

Figure 12:
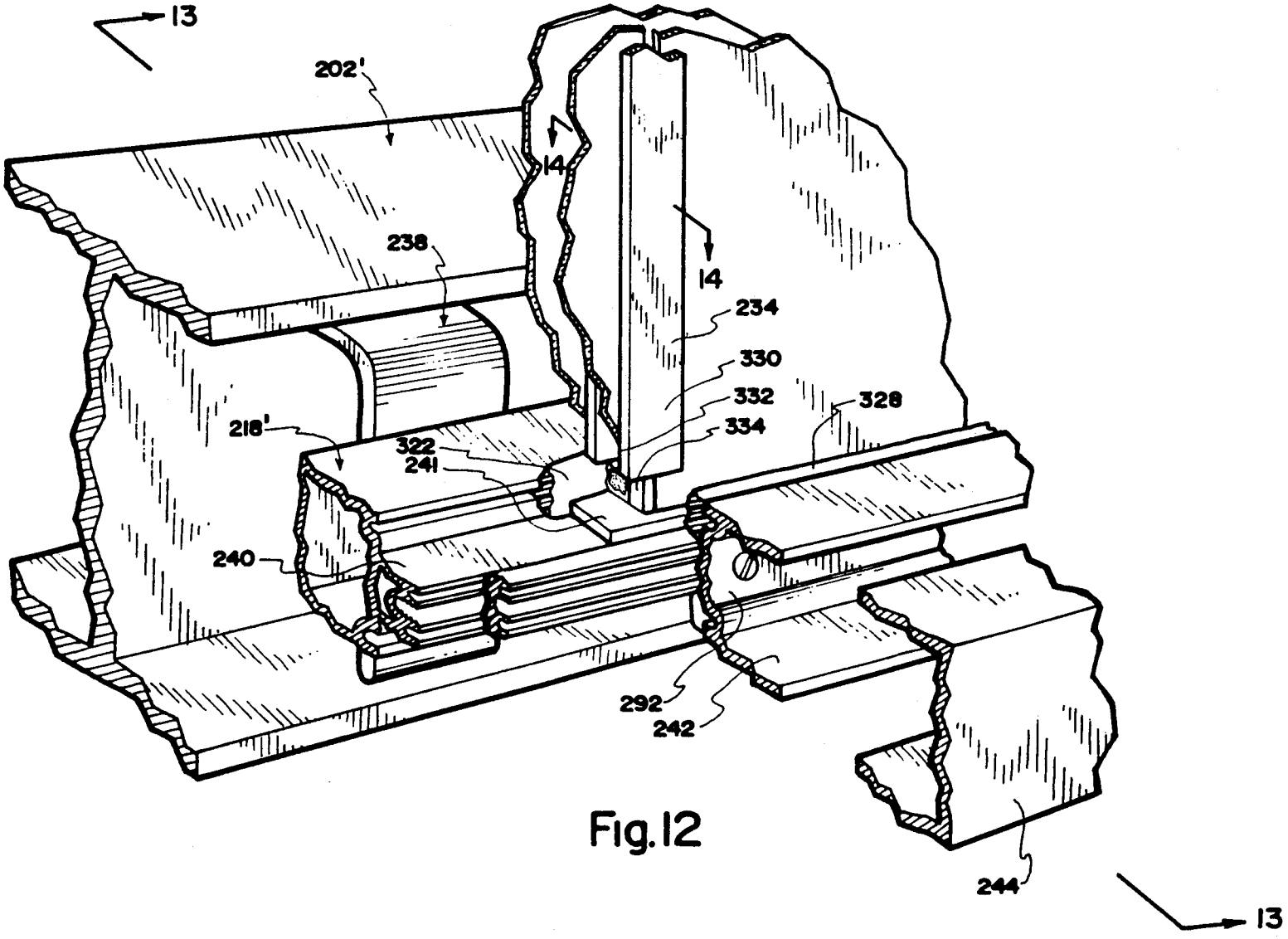
FIG. 12 is a perspective of a portion of the building seen in FIG. 11 with a pressure plate added to hold the I.G. unit in place and with portions of parts removed for clarity of presentation.
Figure 13:
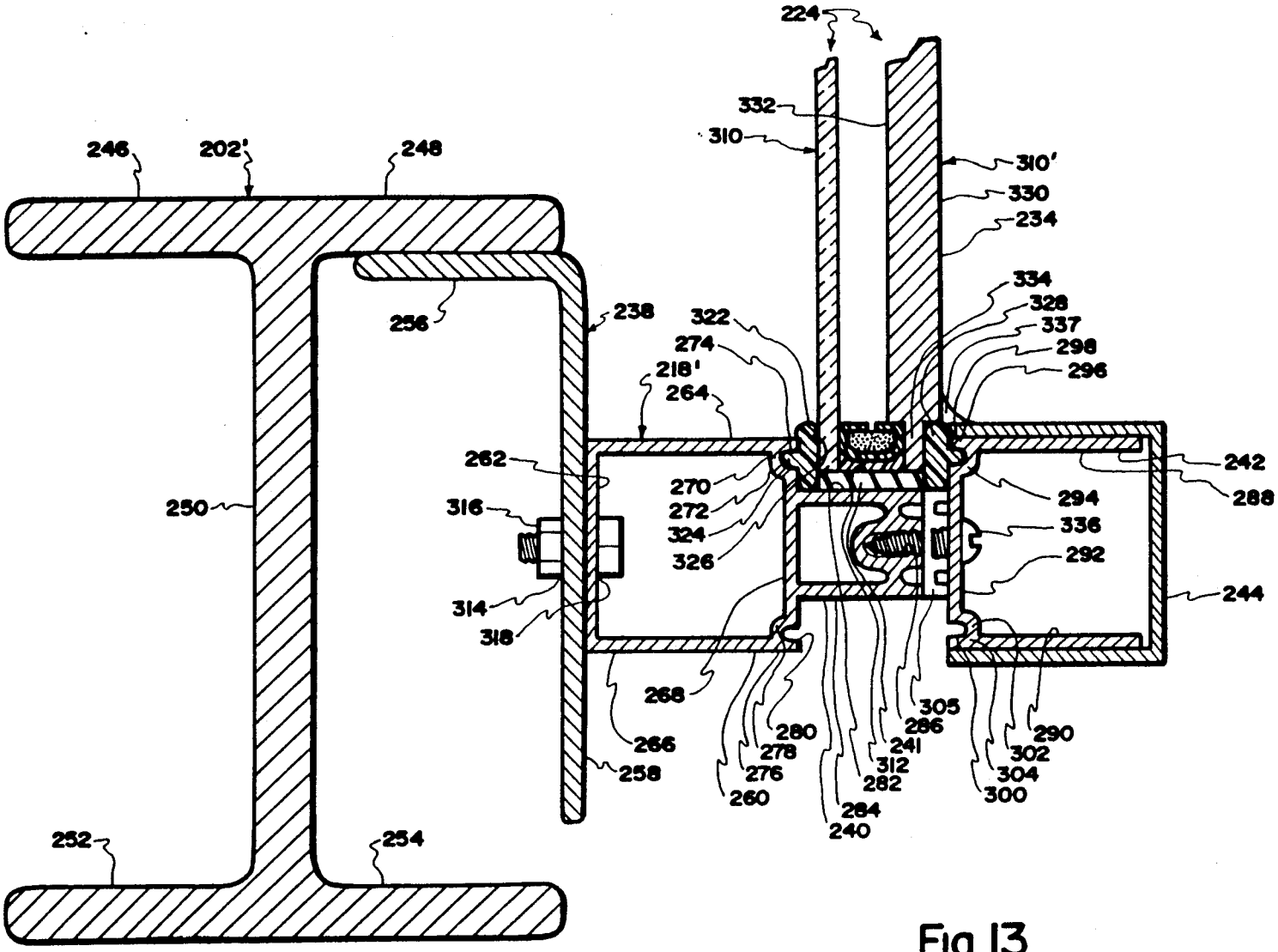
FIG. 13 is a section taken along lines 13—13 in FIG. 12.

One example of attachment of I.G. units 10 to a building is seen in FIGS. 11–13. In FIG. 11, a portion of a building 20'', with parts removed for clarity, is seen to comprise horizontal I beams 202', 204', and 206', exposed at the outer edge of each floor 208', 210', and 212', respectively, of building 20''. Such exposed I beam construction is currently frequently used in building fabrication.

Commonly practiced in contemporary architecture, vertical and horizontal mullions are attached to and disposed across the exterior face of the I beams to form a lattice framework upon which windows and other building facings are affixed to the exterior of a building. As seen in FIG. 11, two vertical mullions 214' and 216' and two horizontal mullions 218' and 220' form a portion of a building 20'' lattice framework 222. It should be noted that no mullion is mounted on I beam 204'. In the case of building 20'', lattice framework 222 comprises an array of mullions used to affix two story tall I.G. units to building 20''. Such an I.G. unit 224 is disposed between horizontal mullions 218' and 220' and vertical mullions 214' and 216'.

I.G. unit 224 comprises three separate glass sections 226, 228, and 230. An H-shaped part 232 separates glass section 228 from glass sections 226 and 230 and is attached to glass sections 226, 228 and 230 in the same manner described for H-shaped part 110 in FIG. 4. Another H-shaped part 234 separates glass sections 226 and 230 and is attached to sections 226 and 230 in the same manner as H-shaped part 232 is attached. In combination, glass sections 226, 228, and 230 and H-shaped parts 232 and 234 form an exterior lite 236 which is strong and hermetically sealed. Of course, lite 236 is combined with other parts as disclosed in FIG. 4, above, to form I.G. unit 224.

A method for affixing I.G. unit 224 to a mullion is best seen in FIGS. 12 and 13 Portions of I beam 202', mullion 218', and I G unit 224 are magnified in FIG. 12 for clarity. As seen therein, mullion 218' is affixed for support to an "L" shaped mounting bracket 238 which is rigidly and permanently affixed to I beam 202'. Mullion 218' comprises a window support and pressure plate attachment part 240 upon which the weight of I.G unit 224 is disposed through a plurality of spacer blocks. A single spacer block 241 is seen in FIG. 12. A plurality of spacer blocks 241 disposed between I.G. unit 224 and mullions 214', 216', 218' and 220' are seen in FIG. 11 A pressure plate bearing part 242 is affixed to part 240 to capture I.G. unit 224 between mullion 218' and part 242. An unattached cover 244 for part 242 is also seen, separated and proximally disposed from part 242.

A cross section showing more detail of I.G. unit 224 attachment to mullion 218' and associated parts is provided in FIG. 13. Relative to building 20'', I beam 202' comprises an interiorly disposed top member 246, an exteriorly disposed top member 248, a vertical member 250, and an interiorly disposed bottom member 252 and an exteriorly disposed bottom member 254. "L" shaped mounting bracket 238 comprises a horizontal leg 256 and a vertical leg 258.

Mullion 218' comprises a rectangularly shaped tube 260 comprising a mounting side plate 262, a top extension plate 264, a bottom extension plate 266, and a vertical exterior plate 268. Disposed between plates 264 and 268 is a corner section 270 comprising a fillet 272 and a groove 274 exteriorly exposed in fillet 272. Another corner section 276 is disposed between plates 266 and 268 comprises a fillet 278 and a groove 280 which are substantially the same as fillet 272 and groove 274, but of opposite hand.

Unitarily attached to the exterior side of plate 268 is window support and pressure plate attachment part 240. Part 240 comprises a top surface 282, a bottom surface 284, and an exterior face comprising a "U" shaped cavity 286. "U" shaped cavity 286 comprises a plurality of internally disposed triangularly shaped grooves on the top and bottom of the sides of the "U" the purpose of which is described hereafter. Such mullions are made as extruded aluminum parts and are widely available in commerce.

Pressure plate bearing part 242 comprises an open, square C-shape when connected to mullion 218'. So disposed, part 242 comprises a top outwardly extending side 288, a bottom outwardly extending side 290 and a pressure plate 292. Part 242 also comprises a fillet 294 disposed in a corner 296 between side 288 and plate 292. Pressure plate 292 comprises a groove 298 which opens into fillet 294, the purpose for which is described in detail hereafter. Part 242 comprises a similar groove 300 disposed in pressure plate 292 and opening into a fillet 302 at a corner 304 disposed at the intersection of bottom side 290 and plate 292. A spacer 305 is interposed between pressure plate 292 and pressure plate attachment part 240 to adjust for the width of I.G. unit 224.

I.G. unit 224 comprises a structure similar to I.G. unit 10 disclosed in FIG. 2 and comprises a single pane of glass in an interior lite 310 and an exterior multiple section lite 310' which comprises glass sections 226, 228 and 230, but are unseen in FIG. 13 due to the section therein being taken across H-shaped part 234. Further I.G. unit 224 comprises an exterior sealant 164 formed edge 312.

Cover 244 comprises a releasible finishing cover for part 242 and is normally attached by snapping or sliding onto indented segments of part 242. In addition, cover 244 may provide a strengthening member when attached to part 242. Pressure plates and covers are made as extruded parts and are commercially available.

To install I G unit 224 to I beam 202', "L" mounting bracket 238 horizontal leg 256 is first permanently attached by welding or bolting or the like to the inferior side of top member 248 such that vertical leg 258 is exteriorly exposed. A hole 314 is medially disposed between I beam members 248 and 254 in vertical leg 258 for a nut and bolt combination 316. A similar hole 318 is disposed in side plate 262 and juxtaposed hole 314. Nut and bolt combination 316 is inserted through holes 316 and 318 and securely tightened to firmly affix mullion 218' to vertical leg 258.

A plurality of hard rubber rectangularly shaped spacer blocks, represented by block 241, also seen in FIGS. 11 and 12, are disposed as spacers between I.G. unit 224 and top surface 282 of pressure plate attachment part 240. A gasket 322 of resilient synthetic resinous material comprising a groove 274 engaging tab 324 and a window compressing bulbous side 326 opposite tab 324 is attached to mullion 218' by inserting tab 324 into groove 274. So positioned, gasket 322 provides a pressure transmitting interface between mullion 218' and I.G. unit 224. A gasket 328, similar in shape and function to gasket 322 is inserted into groove 298 to provide a pressure transmitting interface between pressure plate 292 and I.G. unit 224.

Referring again to FIG. 12, H-shaped part 234 is seen to comprise an exterior side 330 and an interior side 332. Exterior side 330 is connected to interior side 332 by an intermediate rectangular section 334. Note that a differentiating feature between I.G. unit 10 and I.G. Unit 224 is that a portion of side 330 is removed in the vicinity of the interface between gasket 328 and I.G. unit 224. The removal of the portion of side 330 permits I.G. unit 224 to present a smooth surface to pressure plate 292 through gasket 328.

Part 242 is affixed to mullion 218' by inserting a screw 336 through a hole in pressure plate 292. Screw 336 threadably binds to the triangularly shaped grooves in cavity 286 and is tightened therein to apply pressure to I.G. unit 224 between mullion 218' and gasket 322 and gasket 328 and pressure plate 292. At predetermined distances along pressure plate 292, additional screws 336 are also securely inserted and tightened to apply pressure to I.G. unit 224 in a similar manner. Note, that a portion of pressure applied to I.G. unit 224 by pressure plate 292 is applied to the exposed and captured portion of intermediate section 334 of H-shaped part 330 disposed between mullion 218' and pressure plate 292. In like manner, each H-shaped part 110 extending to an edge of an associated I.G. unit 10 comprises a compressive connecting attachment to a mullion disposed at that edge of the I.G. unit. This attachment provides cantilevered support from mullion 218' and pressure plate 292 for each connected H-shaped part 110 and each associated interfacing glass section 100.

Once each pressure plate 242 is secured by screws to each associated mullion 218', cover plate 244 is attached to plate 242 and a bead of sealant 337, preferably silicone caulk, is disposed along the interface at gasket 328 to finish the installation. As is seen by grooves 280 and 300 and associated mullion 218' and pressure plate 292, respectively, a similar attachment to the one described above for I.G. unit 224 is available for attachment to the top of another I.G. unit below I.G. unit 224.

Figure 14:
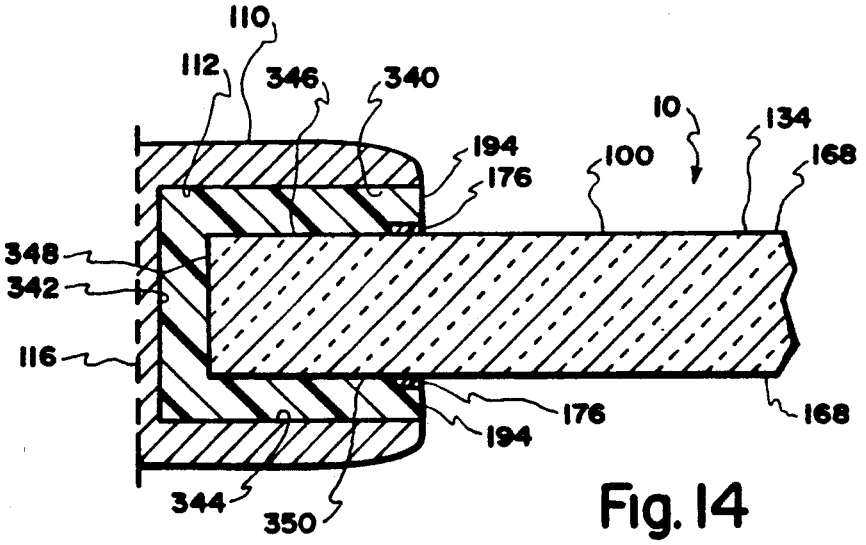
FIG. 14 is a truncated section taken along lines 14—14 in FIG. 12.
Figure 14A:
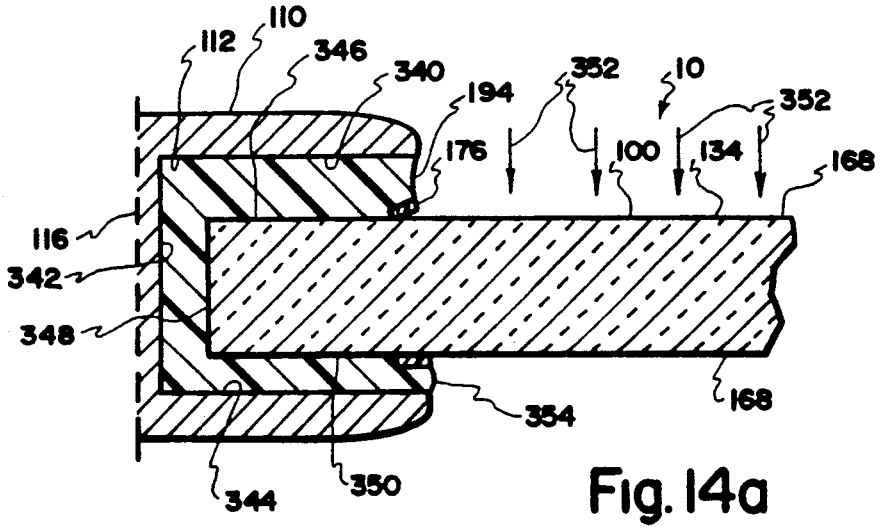
FIG. 14A is a section similar to the section seen in FIG. 14 with portions moved to show an effect of pressure or other stress such as that caused by wind load.
Figure 14B:
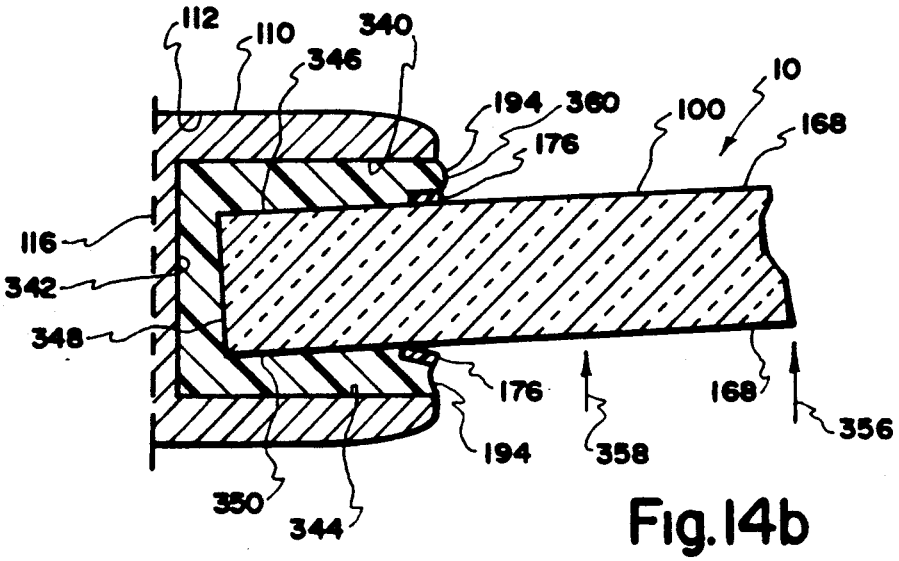
FIG. 14B is a section similar to the section seen in FIG. 14A showing another effect of environmental stress.

Referring to FIGS. 14, 14*a* and 14*b*, examples of the nature of response of sealant 194 to movement of a glass section 100 relative to the recess of channel 112 of H-shaped part 110 in an I.G. unit 10 is seen. For ease of reference and clarity of presentation only a half of H-shaped part 110, divided along dashed line 174 first seen in FIG. 8, with a section 134 of glass disposed in channel 112 of H-shaped part 110 is provided in FIGS. 14, 14A and 14B. Also, the thickness of sealant 194 is magnified for clarity of presentation.

FIG. 14 shows glass section 134 in a position relative to channel 112 when glass section 134 is not under stress. As seen in FIG. 14, channel 112 comprises contiguous interior surfaces 340, 342 and 344. Surface 168 of glass section 134 comprises enclosed and bonded surfaces 346, 348 and 350. A remnant of tape 176 is seen at both surfaces 346 and 350 where a portion of tape 176 and excess sealant 194 has been removed during prior fabrication of I.G. unit 10. As disclosed above and seen in FIGS. 8, 8A, and 8B, tape 176 comprising a releasible adhesive is used to separate otherwise difficult to remove sealant 194 from surface 168. As sealant 194 cures within channel 112, an adhesive bond is created between sealant 194 and surfaces 340, 342 and 344 and surfaces 346, 348, and 350.

As seen in FIG. 14*a* when translational forces are applied to glass section 134 in a direction indicated by arrows 352, sealant 196 is compressed against supporting channel 112 in opposition to such forces causing sealant 194 to bulge at site 354. Channel 112 provides a linear support along a part of an H-shaped part 110. At the same time bonding is adhesively maintained along surfaces 340 and 346, except at the site where tape 176 contacts surface 346, and along surfaces 342 and 348 due to the elasticity of sealant 194. Elastic and compressive forces within sealant 194 and static support of H-shaped part 110 force return of section 134 to the relative position seen in FIG. 14 when the forces indicated by arrows 352 are removed.

When forces against section 134 are distributed in unequally across surface 168, as indicated by the relative length of arrows 356 and 358, torsional movement of sealant 194 results as seen in FIG. 14*b*, resulting in a twisting of segment 134 within channel 112. In the example seen in FIG. 14*b*, torsional movement of sealant 194 results in compressive bulging of sealant 194 at site 360, a separation of tape 176 from surface 350 and elastic stretching of sealant 194 along selective portions between surfaces 342 and 348, 340 and 346, and 344 and 350 limited by structure and position of channel 112 of H-shaped part 110.

In cases such as those provide by the examples above and in other possible movement of section 134 relative to channel 112, the bonding characteristics and resiliency of sealant 194 maintain a hermetic seal between section 134 and H-shaped part 110. Similarly, during other differential movement of section 134 relative to H-shaped part 110, such as movement caused by differential thermal expansion, the hermetic seal is maintained by the bonding and elastic characteristics of sealant 194.

The invention may be embodied in other specific forms without departing from the spirit or essential characteristics thereof. The present-embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In combination, a building comprising a lattice framework defining an array of openings extending horizontally and vertically and a plurality of asymmetrical design-carrying IG units and/or spandrel units secured respectively in at least some of the openings;

each unit comprising:

a periphery;

an exterior lite;

an interior lite spaced from the exterior lite;

an isolated dead air space between the exterior and interior lites, the dead air space comprising a perimeter;

structure between the exterior and interior lites at the periphery sealing the perimeter of the dead air space against influent and effluent fluid flow;

at least one lite of several juxtaposed units comprising a plurality of glass sections comprising an asymmetrical pattern substantially disposed in a common plane in spaced edge-to-edge orientation and one-piece aluminum H-shaped connectors bridging between and receiving in opposed recesses said spaced glass section edges, at least a plurality of ends of the connectors abutting the lattice framework;

material interposed between said spaced edges and said recesses, said material comprising a deflectable elastic U-shaped bonding and sealing interface which resiliently creates and preserves a hermetic seal between the connectors and the associated glass edges continuously preventing influent and effluent fluid flow between the connectors and the associated glass section edges notwithstanding periodic imposition on the glass sections of deflecting wind loads and other environment stresses;

each lattice-abutting connector end of one juxtaposed unit being aligned with an immediately adjacent lattice-abutting connector end of another juxtaposed unit whereby the H-shaped connectors of the juxtaposed units defining a multiple unit continuous asymmetrical visual image.

2. A combination according to claim 1 wherein the interposed material is selected from the group consisting of silicone sealants and polybutyl-sulfide sealants.

3. A combination according to claim 1 wherein the periphery sealing structure comprises desiccant material exposed at the dead air space for reducing visual effects of condensation on the inside of the insulated glass window.

4. A combination according to claim 1 wherein the plurality of glass sections comprise a plurality of colors.

5. A combination according to claim 1 wherein some of the aluminum H-shaped connectors comprise a first end which abuts another aluminum H-shaped connector between the ends thereof and a second end which abuts the lattice framework.

6. A combination according to claim 1 wherein the periphery sealing structure comprises at least two angularly related spaced and hollow rigid structural members contiguous with the inside surfaces of the exterior and interior lites immediately adjacent the perimeter of the dead sir space and a flexible corner insert spanning between the hollow of the two rigid structural members to form a corner.

7. A combination according to claim 1 wherein the periphery sealing structure comprises rigid structural members at the perimeter of the dead air space which define the thickness of the dead air space.

8. A combination according to claim 1 wherein at least some of the H-shaped connectors are solid in cross-section.

9. A combination according to claim 1 wherein at least some parts of at least some of the H-shaped connectors comprise a curved configuration.

10. A combination according to claim 1 wherein the periphery sealing structure comprises at least one rigid structural member contiguous with the inside surface of the exterior and interior lites of each unit immediately adjacent the perimeter of the dead air space and a layer of polymeric sealant superimposed over the rigid structural member at said perimeter of the dead air space.

11. A combination according to claim 10 further comprising desiccant material contiguous with the structural member and exposed within the dead air space.

12. A decorative window array for a multi-story building comprising:

a custom, random asymmetrical display spanning over a plurality of vertically and horizontally sequentially located multilithic exterior decorative lites of IG units arranged generally in edge-to-edge relation, each said exterior decorative lite being exposed to the atmosphere and comprising part of an IG unit comprising an interior lite and a sealed dead air space between the exterior and interior lites;

each said IG unit also comprising peripheral dead air space seal;

each said exterior decorative lite comprising at least one one-piece H-shaped aluminum structural connecting strip and a plurality of aligned, spaced glass pieces comprising edges disposed remote from the periphery, each remote edge extending into an associated recess of one H-shaped aluminum structural connecting strip and sealant interposed between each glass piece abutting edge and the associated recess of the one H-shaped aluminum structural connecting strip which adhesively joins, bonds, and hermetically seals the edge and recess together against air leakage due to wind loads and other deleterious effects of weather, each end of at least some of the H-shaped structural connecting strips of one IG unit abutting a window framework in visual alignment with one framework abutting one end of another H-shaped structural connecting strip of another IG unit.

13. In combination, a building defining an array of openings and a plurality of IG units and/or spandrel units collective presenting a decorative image, each unit being secured in at least some of the openings;

each unit comprising:

a periphery;

an exterior lite;

an interior lite spaced from the exterior lite;

an isolated dead air space between the exterior and interior lites, the dead air space bordering directly against both lites and comprising a perimeter;

seal structure between the exterior and interior lites at the periphery bordering against and sealing the perimeter of the dead air space against influent and effluent fluid flow;

at least one lite of several juxtaposed units comprising a plurality of glass sections collectively comprising a continuous asymmetrical pattern comprising said decorative image and substantially disposed in a common plane in spaced edge-to-edge orientation and one-piece preformed H-shaped connectors bridging between and receiving in opposed recesses said spaced glass section edges, at least a plurality of ends of the connectors abutting building structure at the openings;

resilient hinge-forming material interposed between said spaced edges and said recesses, said material comprising a deflectable elastic bonding and sealing interface which resiliently creates and preserves a hermetic seal between the connectors and the associated glass edges continuously preventing influent and effluent fluid flow between the connectors and the associated glass section edges notwithstanding periodic imposition on the glass sections of wind loads and other environment stresses.

14. A combination according to claim 13 wherein the interposed material is selected from the group consisting of silicone sealants and polybutyl-sulfide sealants.

15. A design-carrying IG and/or spandrel unit comprising:

a periphery;

an exterior lite;

an interior lite spaced from the exterior lite;

an isolated dead air space between the exterior and interior lites, the dead air space comprising a perimeter;

frame structure between the exterior and interior lites at the periphery sealing the perimeter of the dead air space against influent and effluent fluid flow;

at least one of the lites comprising a plurality of glass sections comprising an asymmetrical pattern substantially disposed in a common plane in spaced edge-to-edge orientation and at least one one-piece H-shaped connector bridging between and receiving in opposed recesses said spaced glass section edges, the at least one connector comprising two ends, each end extending to the periphery and adapted to abut a building framework upon installation;

resilient hinge-forming material interposed between said spaced edges and said recesses, said material comprising a deflectable elastic U-shaped bonding and sealing interface which resiliently creates and continuously preserves a hermetic seal between the connectors and the associated glass edges thereby preventing at all times influent and effluent fluid flow between the connectors and the associated glass section edges notwithstanding periodic imposition on the glass sections for deflecting wind loads and other environment stresses.

16. A unit according to claim 15 wherein the resilient hinge-forming material is selected from the group consisting of silicone sealants and polybutyl-sulfide sealants.

17. A method of making an insulated glass unit comprising the steps of:

forming a first lite;

forming a second lite by providing a plurality of glass sections collectively comprising an asymmetrical pattern, disposing the glass section in said asymmetrical pattern in a common plane in spaced opposed edge-to-edge orientation, forming H-shaped connectors to correspond to the opposed edge-to-edge orientation of the glass sections, placing said opposed edges into opposed recesses of the connectors, interposing a resilient material between said spaced opposed edges and said recesses, whereby the material bonds to and seals against the glass sections and the connectors to create and preserve a hermetic closure between the connectors and the associated glass section edges to continuously prevent fluid flow therebetween notwithstanding periodic imposition on the glass sections of deflecting wind loads and other environment stresses;

connecting peripheral regions of each lite with perimeter sealing and frame structure to create a dead air space between the lites.

18. A method for providing a custom collective design exposed at an exterior of a building formed of units of insulated glass comprising the steps of:

forming a first lite of at least some of the insulated glass units by providing a plurality of glass sections collectively comprising an asymmetrical pattern, disposing the glass section in said asymmetrical pattern in a common plane in spaced opposed edge-to-edge orientation, forming H-shaped connectors to correspond to the shape of the opposed edge-to-edge orientation of the glass sections, placing said opposed edges into opposed recesses of the connectors, interposing a resilient material interposed between said spaced opposed edges and said recesses whereby the material bonds to and seal against the glass sections and the connectors to create and preserve a hermetic closure between the connector and the associated glass section edges to continuously prevent fluid flow therebetween notwithstanding periodic imposition on the glass sections of deflecting wind loads and other environment stresses;

connecting peripheral regions of the first and second lites of the at least some insulated glass units with perimeter sealing and frame structure to create a dead air space between the lites;

placing and securing the at least some insulating glass units in window openings in a framework of the building so that ends of H-shaped connectors of one insulated glass unit abut the framework in alignment with ends of other H-shaped connectors of other insulated glass units thereby defining said custom collective design.

19. A method of making a window lite comprising the steps of:

cutting a plurality of asymmetrical sections of glass into a pattern having interior edges;

shaping one or more H-shaped connectors into a configuration corresponding to at least part of the interior edge pattern of cut glass sections;

adhering tape on the glass sections at each interior edge;

placing the taped interior edges into opposed U-shaped recesses of the H-shaped connector;

interposing a moldable sealant in each U-shaped recess;

removing any tape and sealant exposed beyond the recess.

* * * * *